US005614795A

United States Patent [19]

Kim

[11] Patent Number: 5,614,795

[45] Date of Patent: Mar. 25, 1997

[54] FIELD EMISSION DEVICE

[75] Inventor: Jong-min Kim, Seoul, Rep. of Korea

[73] Assignee: Samsung Display Devices Co., Ltd., Suwon, Rep. of Korea

[21] Appl. No.: 509,059

[22] Filed: Jul. 31, 1995

[30] Foreign Application Priority Data

Mar. 29, 1995 [KR] Rep. of Korea ..... 95-6889

[51] Int. Cl.[6] ..... H01J 1/02; H01J 9/02; H01J 63/02

[52] U.S. Cl. ..... 313/336; 313/495; 313/351; 313/309; 445/24; 445/50

[58] Field of Search ..... 313/495, 309, 313/336, 351; 445/24, 49, 50

[56] References Cited

U.S. PATENT DOCUMENTS

| | | | |
|---|---|---|---|
| 5,063,327 | 11/1991 | Brodie et al. | 313/309 |
| 5,090,932 | 2/1992 | Dieumegard et al. | 445/24 |
| 5,148,079 | 9/1992 | Kado et al. | 313/309 |
| 5,266,155 | 11/1993 | Gray | 437/195 |
| 5,382,867 | 1/1995 | Maruo et al. | 313/309 |
| 5,386,172 | 1/1995 | Komatsu | 313/309 |
| 5,457,355 | 10/1995 | Flemming | 313/336 |

*Primary Examiner*—Micheal Horabik
*Assistant Examiner*—Michael Day
*Attorney, Agent, or Firm*—Foley & Lardner

[57] ABSTRACT

A field emission device has a rear substrate (11), a titanium adhesive layer (12) having a striped pattern and disposed on the inner surface of the substrate (11), a tungsten cathode (13) disposed on the adhesive layer (12), a micro-tip (13') protruding from the cathode (13), an aluminum mask layer (14') having a striped pattern and disposed on the cathode (13), an insulating layer (15) having a striped pattern and disposed on the mask layer (14'), a gate (18) having a striped pattern and disposed on the insulating layer (15), and an anode (16) having a striped pattern perpendicular to the striped of the cathode (13) and disposed on a front substrate (19). The micro-tip (13') is formed by simultaneous etching of the tungsten cathode (13), the titanium adhesive layer (12), and the upper aluminum mask (14') resulting in a large internal stress in the micro-tip (13'). The residual internal stress in the micro-tip (13') results in the micro-tip (13') curving toward the anode (16) which, consequently, facilitates electron emission.

20 Claims, 9 Drawing Sheets

FIELD EMISSION DEVICE

BACKGROUND OF THE INVENTION

The present invention relates to a field emission device which can facilitate the formation of a micro-tip for emitting electrons by a field effect.

As an image display device which can replace the existing cathode ray tube of a television set, the flat panel display has been under vigorous development for use as an image display device for wall-mounted (tapestry) televisions or high definition televisions (HDTV). Such flat panel displays include liquid crystal devices, plasma display panels and field emission devices, among which the field emission device is widely used due to the quality of its screen brightness and low power consumption.

The structure of a conventional vertical field emission device will now be described with reference to FIG. 1.

The vertical field emission device includes a rear glass substrate 1, a cathode 2 formed on rear glass substrate 1, a field emission micro-tip 4 formed on cathode 2, an insulation layer 3 formed on cathode 2, and having a hole 3' for surrounding micro-tip 4, a gate 5 formed on insulation layer 3 and having an aperture 5' for allowing electron emission by a field effect from micro-tip 4, an anode 6 for pulling electrons emitted from micro-tip 4 so as to impinge onto a fluorescent layer 7 with proper kinetic energy, and a front glass substrate 10 having fluorescent layer 7 deposited thereon and anode 6 formed in a striped pattern.

Also, as shown in FIGS. 2A and 2B, a conventional horizontal field emission device has a structure such that cathode 2 and anode 6 are parallel with substrate 1 so as to emit electrons in parallel with substrate 1, unlike the vertical field emission device shown in FIG. 1.

As shown, an insulation layer 3 is formed on a glass substrate 1, and a cathode 2 and an anode 6 are deposited on an insulation layer 3. A hole 3' of a proper depth is formed on insulation layer 3 disposed between cathode 2 and anode 6, and a gate electrode 5 is provided within hole 3', for controlling the electron emission from cathode 2 to anode 6.

However, in the vertical field emission device using the single tip as shown in FIG. 1, since the flow of electron beams is determined depending on the size of aperture 6' of the gate, a technique for forming a micro-tip of several tens of nanometers is necessary. That is to say, since a highly precise fabrication process of a submicron unit is required for forming the gate aperture depending on the tip size (diameter) and the gate aperture size, there are problems in the process uniformity and the yield in the case of application to a large device. Also, in forming the micro-tip, if the aperture becomes larger, the level of the gate bias voltage becomes higher, thereby necessitating a high voltage.

The horizontal field emission device shown in FIG. 2A has a high yield and a uniform structure in fabrication thereof in contrast with the vertical field emission device. However, the horizontal field effect makes the various applications of electron beam emission difficult. That is to say, since the flow of electron beams is extremely limited to an identical horizontal plane, it is very difficult to apply electron beams.

SUMMARY OF THE INVENTION

To solve the above problems, it is an object of the present invention to provide a field emission device which can emit electrons uniformly and attain a high yield even for a large device.

To accomplish the above object, the field emission device according to the present invention comprises: a rear substrate; an adhesive layer formed on the rear substrate in a striped pattern; a cathode formed on the adhesive layer in a striped pattern; a micro-tip protruded upwardly by etching a predetermined portion of the cathode in a triangular shape; a mask layer formed on the portion of the cathode where the micro-tip is not positioned; an insulating layer formed on the mask layer in a striped pattern; a gate formed on the insulating layer in a striped pattern; a front substrate disposed opposingly to the rear substrate, spaced apart by a predetermined spacing; and an anode formed on the front substrate disposed opposingly to the rear substrate in a striped pattern across the cathode.

In the present invention, the adhesive layer is preferably formed of titanium or aluminum, the mask layer is preferably formed of titanium, and the cathode is preferably formed of tungsten. Also, the micro-tip has preferably a protrusion angle of 60°~70° from the rear substrate.

BRIEF DESCRIPTION OF THE DRAWINGS

The above objects and advantages of the present invention will become more apparent by describing in detail a preferred embodiment thereof with reference to the attached drawings in which:

FIGS. 2A and 2B show a conventional horizontal field emission device, in which FIG. 2A is a vertical section thereof and FIG. 2B is a plan view thereof;

FIGS. 3A and 3B show a field emission device according to the present invention, in which FIG. 3A is a vertical section thereof and FIG. 3B is a partly extracted perspective view thereof;

DETAILED DESCRIPTION OF THE INVENTION

Figure 1:
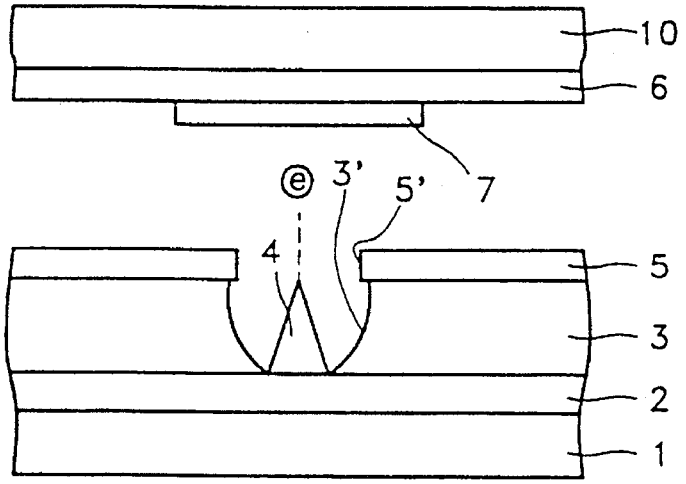
FIG.1 (PRIOR ART)
FIG. 1 is a vertical section of a conventional vertical field emission device.
Figure 2A:
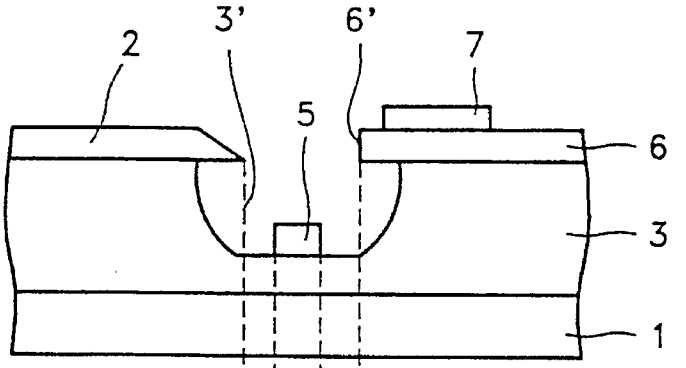
FIG.2A (PRIOR ART)
Figure 2B:
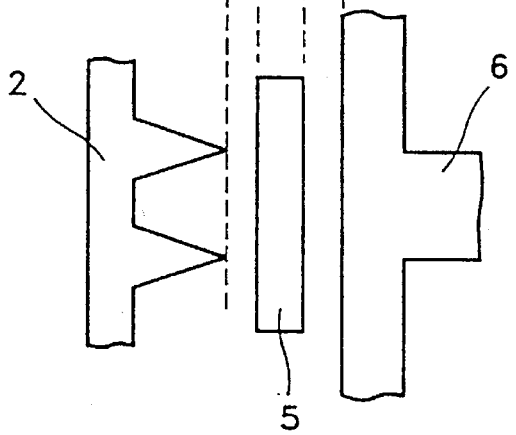
FIG.2B (PRIOR ART)

The structure of the field emission device according to the present invention will now be described with reference to FIGS. 3A and 3B.

The field emission device according to the present invention has a structure in which a glass substrate 11, an adhesive layer 12, a cathode 13, a micro-tip 13', a mask 14', an insulating layer 15 and a gate 18 are sequentially deposited in a striped pattern. Here, micro-tip 13' is successively protruded upwardly on cathode 13 in an array shape. Adhesive layer 12 is formed by depositing titanium or aluminum to a thickness of about 2,000 Å, in which it is rather more advantageous to use titanium than to use aluminum. This is because the etching rate of titanium is faster than that of aluminum. Cathode 13 is formed by depositing tungsten to a thickness of 1 μm. Micro-tip 13' is formed so as to be protruded upwardly 60°~70° by patterning a part of cathode 13 in a triangular shape. Mask layer for forming mask 14' is formed by depositing and patterning titanium or aluminum, like adhesive layer 12, in which it is rather more advantageous to use aluminum whose etching rate is slightly lower than that of titanium, to a thickness of 1,500~2,000 Å. Insulating layer 15 isolates cathode 13 and gate 18 electrically. Gate 18 is formed by depositing chrome and patterning the same.

Tungsten (W) which is a material for cathode 13 positioned between adhesive layer 12 made of titanium and mask layer 14 made of aluminum, has a strong internal stress difference therebetween. Also, tungsten (W) is hardly etched while titanium and aluminum are etched. Since the etching rate of titanium is higher than that of aluminum, lower adhesive layer 12 is preferably made of titanium, and upper mask 14' is preferably made of aluminum. Micro-tip 13' is protruded upwardly by the internal stress while instantaneously etching the adhesive layer in the lower portion of the triangular-shaped structure patterned utilizing the severe etching rate difference and the internal stress difference among the cathode, adhesive layer and mask layer.

Figure 3A:
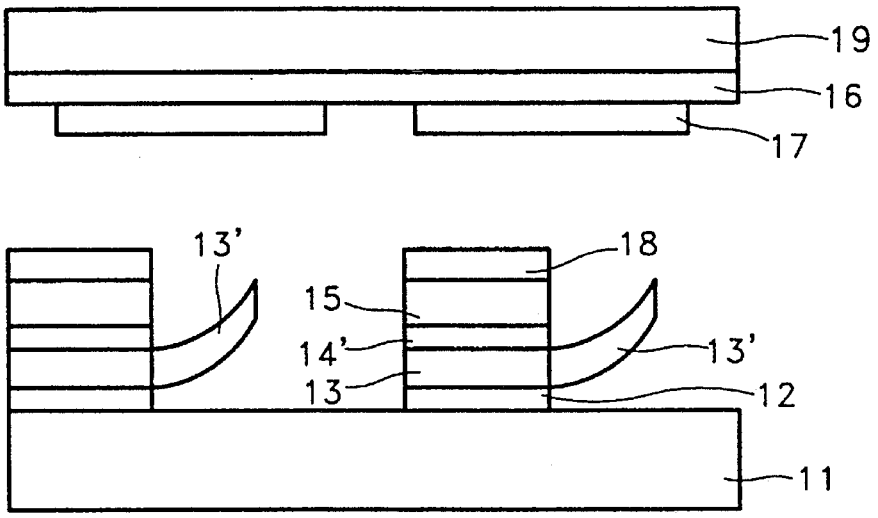

Above micro-tip 13' is provided a front substrate 19 wherein an anode 16 is formed in a striped pattern across cathode 13, as shown in FIG. 3A.

As described above, front substrate 19 is spaced apart from rear substrate 11 wherein micro-tip 13' is formed and having a striped anode 16 being across cathode 13 on the opposite plane of rear substrate 11. When front substrate 19 is coupled to the rear substrate after being coated by a fluorescent layer 17, its edges are air-tightly sealed to then make the inside thereof vacuum, thereby completing the device. At this time, the vacuum extent is at least $10^{-6}$ torr.

Figure 7:
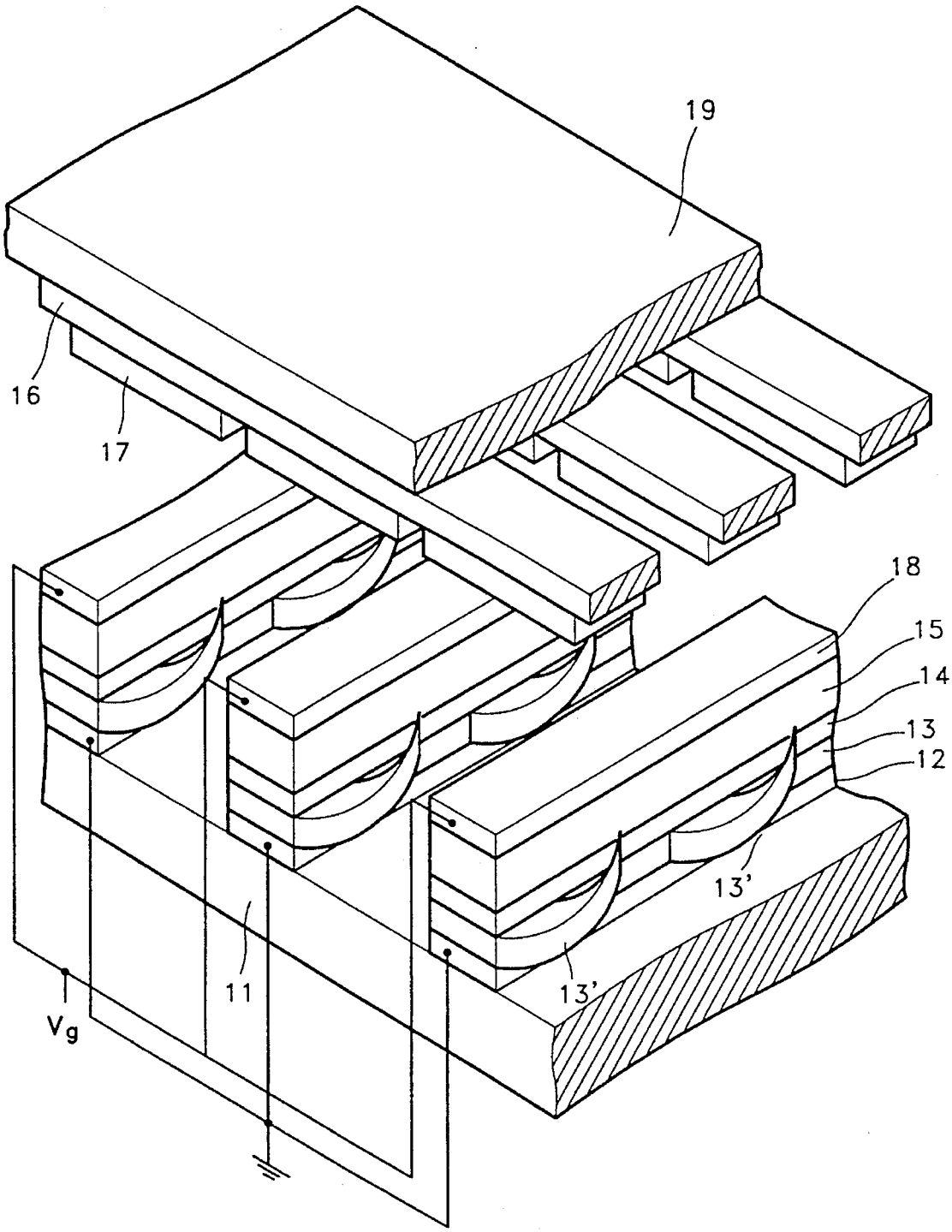
FIG. 7 is a partly extracted perspective view showing an array structure of the field emission device according to the present invention.

As shown in FIG. 7, according to the field emission device having the above-described structure, if cathode 13 being on rear substrate 11 is grounded, a proper control voltage Vg is applied to gate 18 for scanning, and a proper power voltage Va is applied to anode 16, electrons are emitted from tungsten micro-tip 13' due to the strong electric field effect applied to gate, by quantum mechanical penetration effect. At this time, electrons penetrate vacuum space provided by anode and cathode spaced apart from each other, whose edges are sealed. The emitted electrons passing through the vacuum strike fluorescent layer 17 to emit light, thereby obtaining a desired image. Since such an electron emission is performed by a uniform tip size and arrangement, an even luminance is obtained and the overall device life is elongated. The field emission device illustrated and thus far fabricated can be applied to a flat panel display, an ultra-high-frequency-microwave-applied device, an electron-beam-applied scanning electron microscope, an electron-beam-applied system device, or a multiple-beam-emission (pressure) sensor.

The method of fabricating the field emission device having the aforementioned structure will now be described.

Figure 4A:
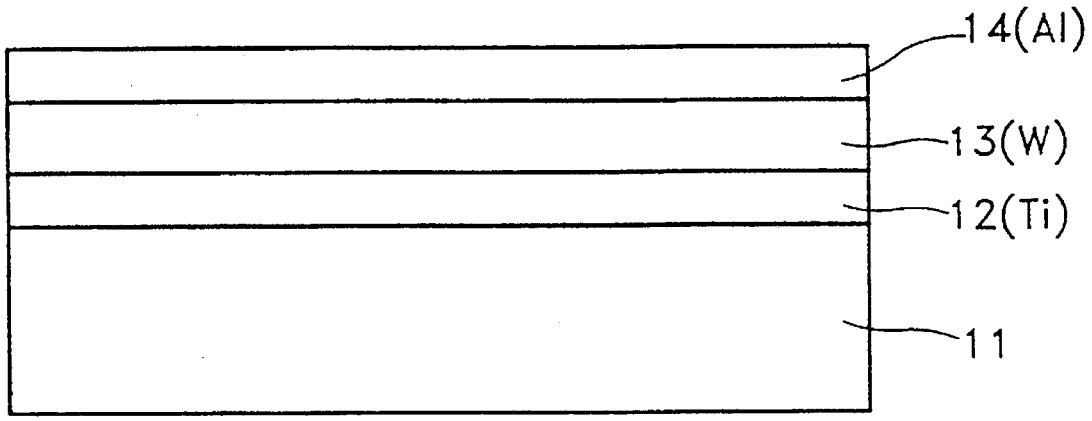
FIGS. 4A to 4F are vertical sections showing a process of fabricating the field emission device according to the present invention.

First, as shown in FIG. 4A, titanium (Ti) is deposited on glass substrate 11 to a thickness of about 2,000 Å to then form adhesive layer 12. Thereafter, tungsten (W) is deposited to a thickness of about 1 μm using a DC-magnetron sputtering method to then form cathode layer 13. Then, aluminum (Al) is deposited to a thickness of 1,500~2,000 Å using the DC-magnetron sputtering method or an electron beam deposition method to then form mask layer 14. Here, the thus-formed cathode layer 13 has a very strong internal stress depending on the processing conditions. The strong internal stress is latent until it is used to protrude potential micro-tip portion 13' of cathode layer 13 upwardly to a very strong extent during rapid etching of adhesive layer 12.

Figure 4B:
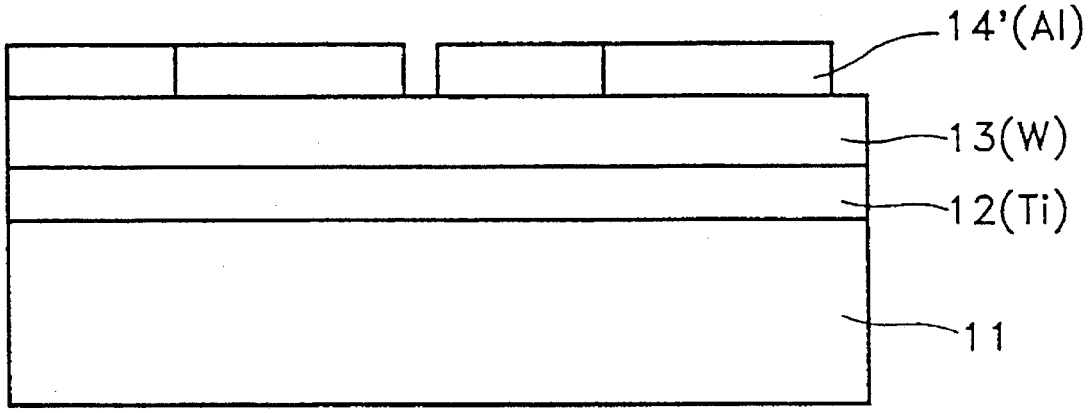
Figure 6:
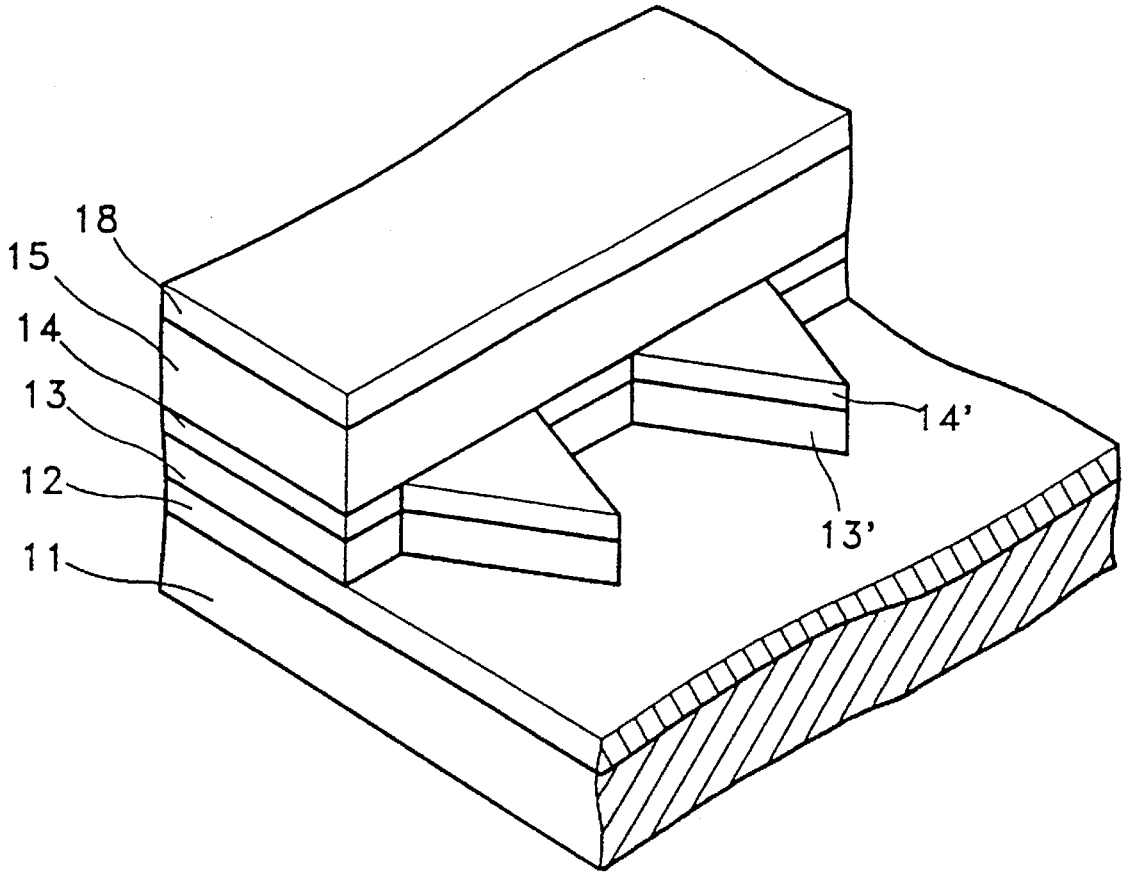
FIG. 6 is a perspective view showing the appearance of the field emission device before a micro-tip is protruded.

Next, as shown in FIG. 4B, Al mask layer 14 is etched using a reactive ion etching (RIE) method to then form a mask 14' for forming the micro-tip. At this time, the plan view of mask 14' has a sharp triangular shape, as shown in FIG. 6, and the sharpness of the tip to be formed is dependent on the shape of mask 14'.

Figure 4C:
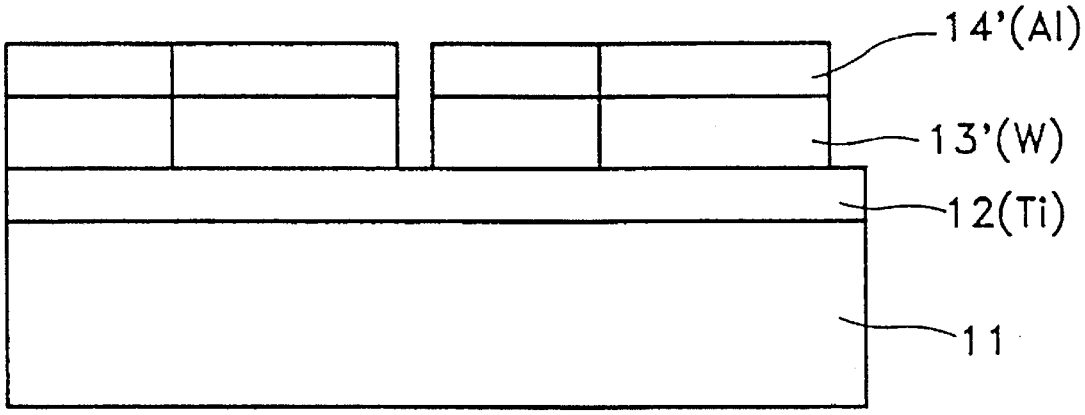

Then, as shown in FIG. 4C, tungsten cathode layer 13 is selectively etched using A1 mask 14' by means of $CF_4$—$O_2$ plasma, to then form potential micro-tip portion 13'.

Figure 4D:
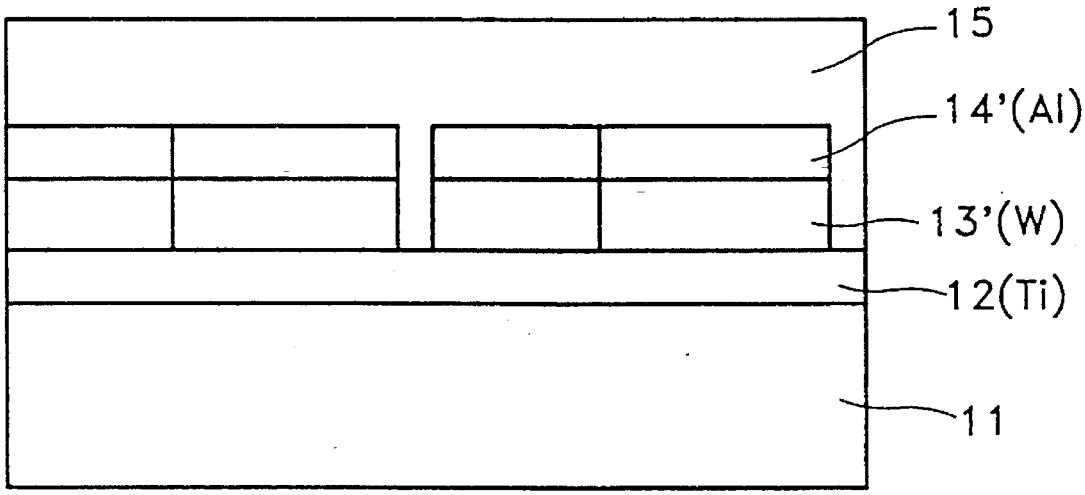
Figure 4E:
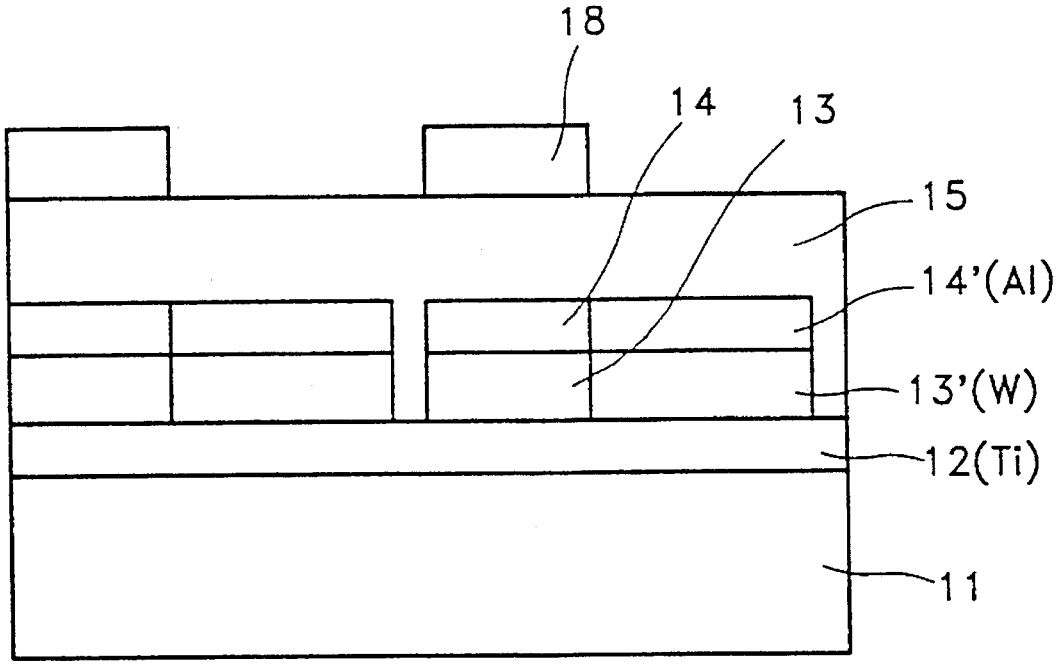

As shown in FIG. 4D, an insulating layer 15 is formed on triangular mask 14' and potential micro-tip portion 13'. Then, as shown in FIG. 4E, chrome is deposited and patterned to form gate 18.

Figure 4F:
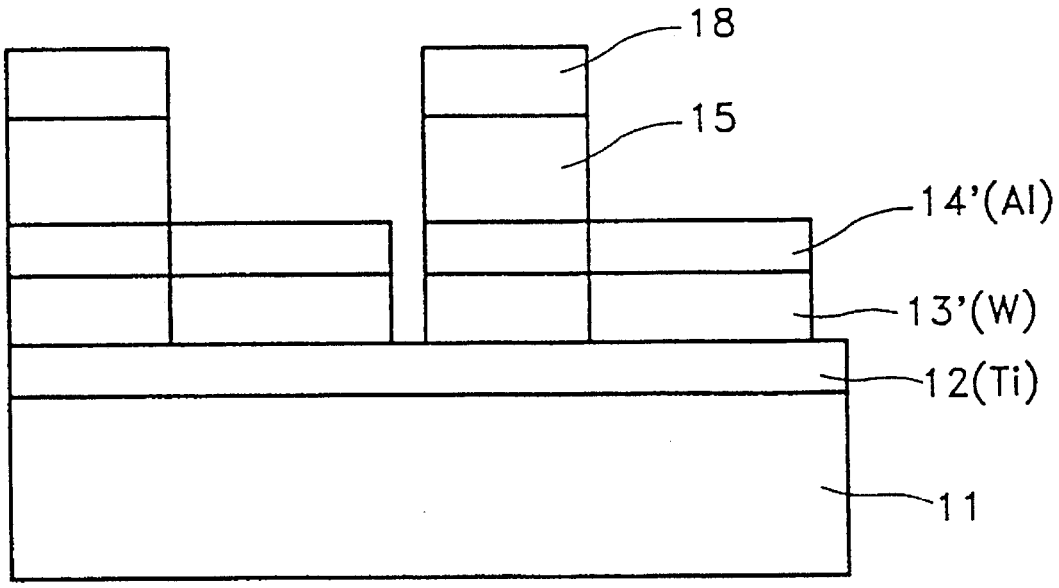

Next, as shown in FIG. 4F, insulating layer 15 is selectively etched using gate 18 as a mask to expose the previously formed Al mask 14' and potential micro-tip portion 13'.

Figure 3B:
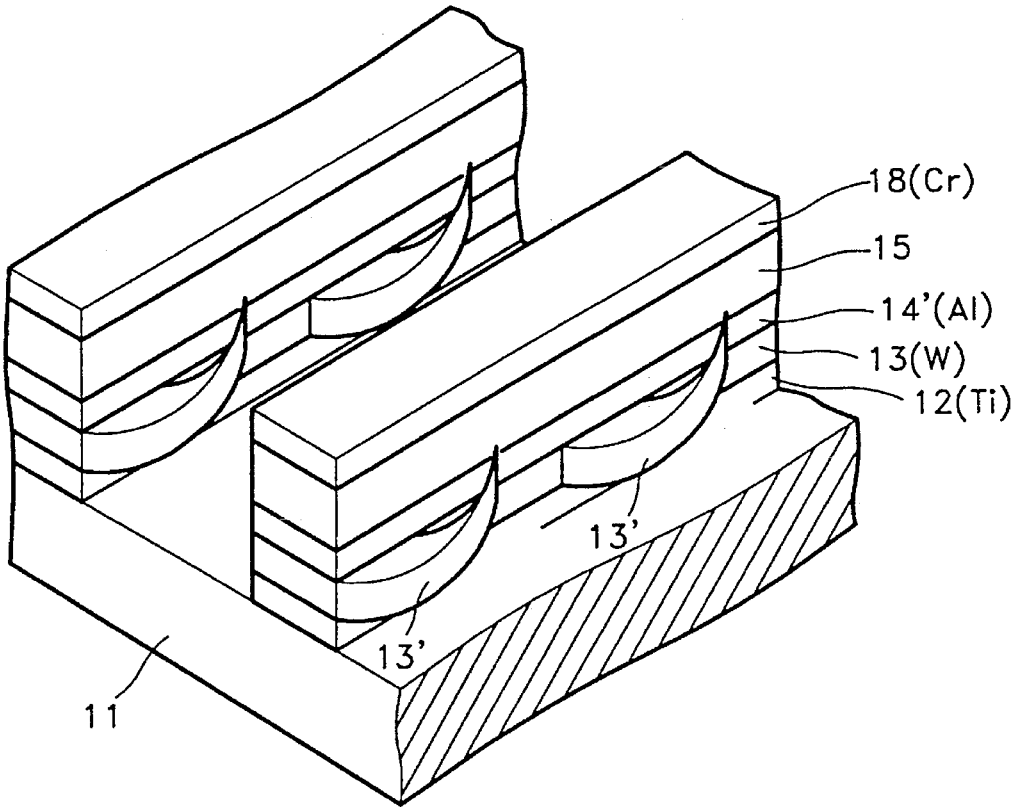

As shown in FIGS. 3A and 3B, micro-tip 13' is formed by selectively etching Ti adhesive layer 12 and the exposed Al mask 14' instantaneously using a buffered oxide etching (BOE) method. At this time, if adhesive layer 12 is instantaneously etched, micro-tip 13' is protruded upwardly by the internal stress of tungsten. Since the etching rate of Ti adhesive layer 12 is very rapid, it is important to control the etching to be finished in a short time. At this time, the etchant used in the BOE method is a solution of HF and $NH_4F$ in the ratio of 7 to 1 up to 10 to 1.

Also, another method of fabricating the field emission device having the aforementioned structure according to the present invention will now be described.

Figure 5A:
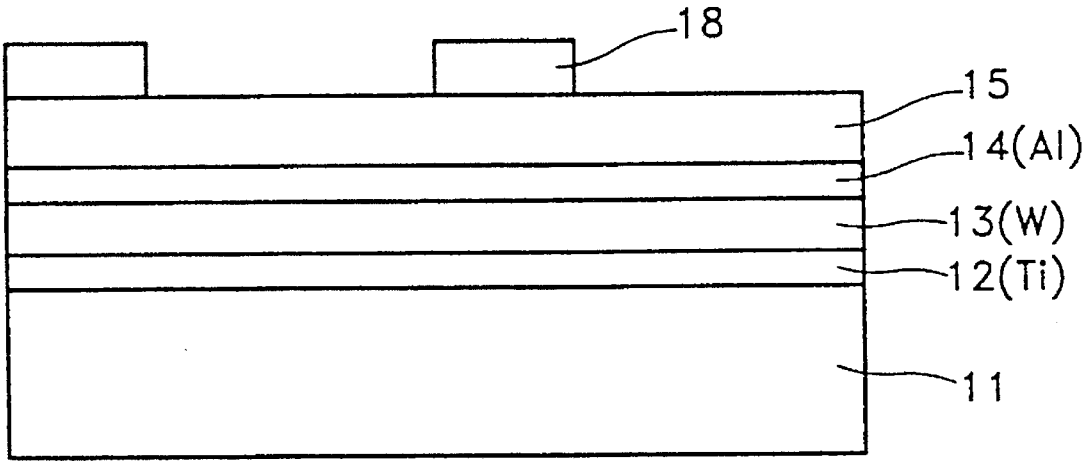
FIGS. 5A to 5D are vertical sections showing another process of fabricating the field emission device according to the present invention.

First, as shown in FIG. 5A, titanium (Ti) is deposited on glass substrate 11 to a thickness of about 2,000 Å to then form adhesive layer 12. Thereafter, tungsten (W) is deposited to a thickness of about 1 μm using the DC-magnetron sputtering method to then form cathode layer 13. Then, aluminum (Al) is deposited to a thickness of 1,500~2,000 Å using the DC-magnetron sputtering method or electron beam deposition method to then form mask layer 14. Then, insulating layer 15 is formed, and a lift-off method is performed with respect therewith to form chromium gate 18. Otherwise, the chromium layer is formed by a deposition method and then is patterned using a photolithographic etching method to form gate 18.

Figure 5B:
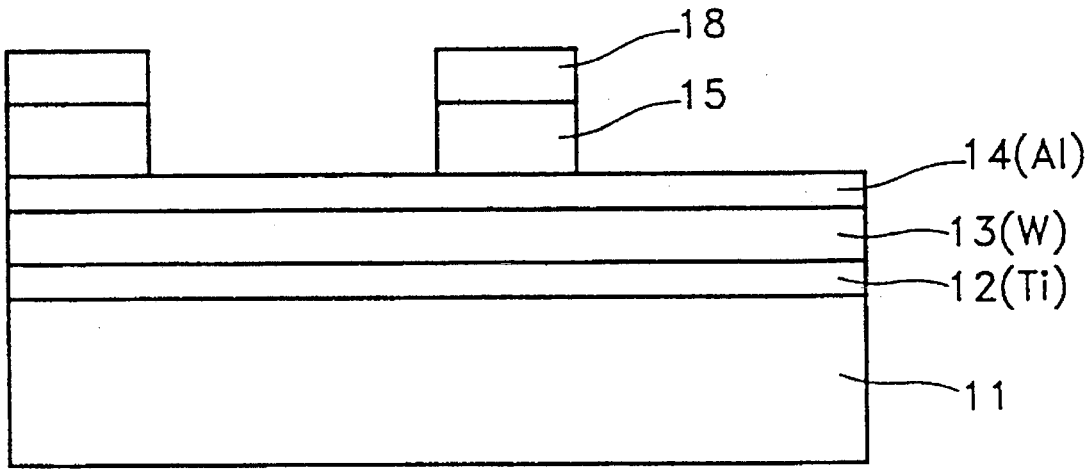

Next, as shown in FIG. 5B, insulating layer 15 is selectively etched using gate 18 as a mask to expose Al mask layer 14.

Figure 5C:
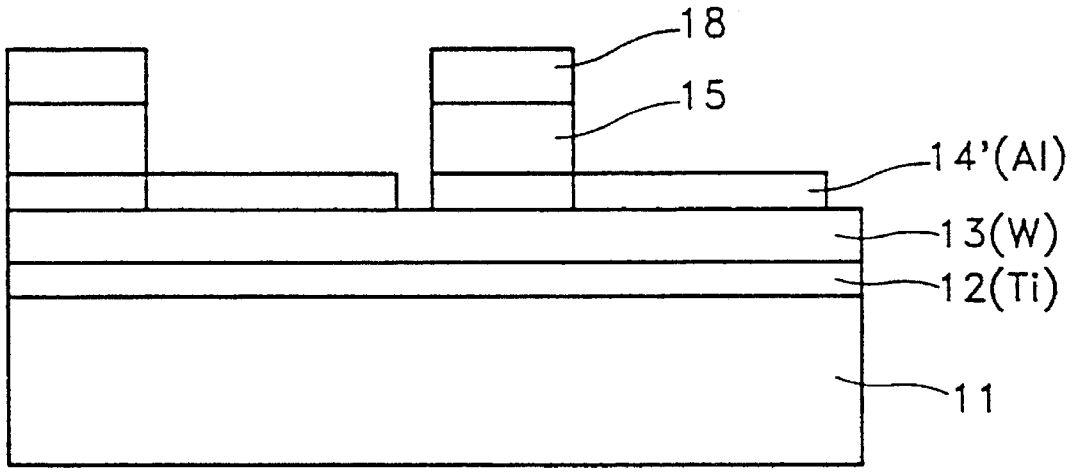

Then, as shown in FIG. 5C, Al mask layer 14 is etched using the reactive ion etching (RIE) method to then form mask 14' for forming the micro-tip. At this time, the plan view of mask 14' has a sharp triangular shape, as shown in FIG. 6, and the sharpness of the tip to be formed is dependent on the method of patterning mask 14'.

Figure 5D:
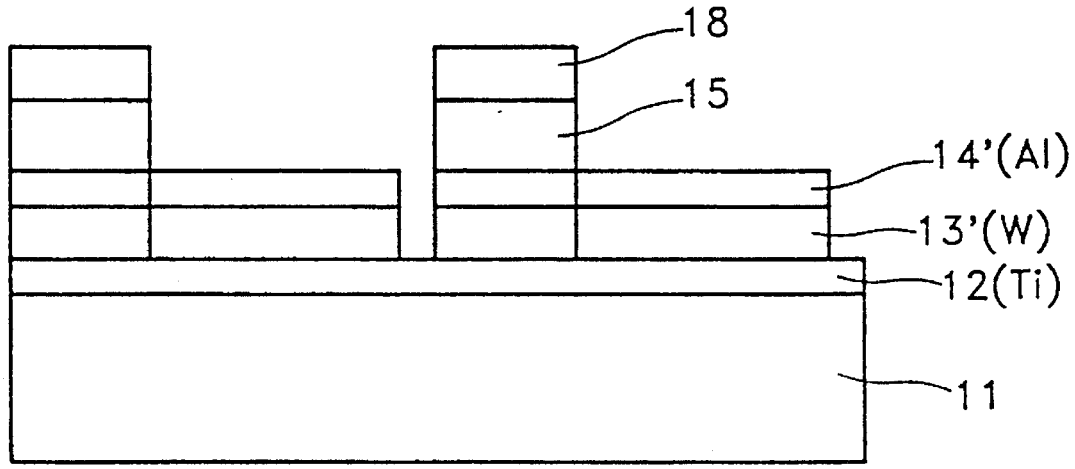

Then, as shown in FIG. 5D, tungsten cathode layer 13 is selectively etched using Al mask 14' by means of $CF_4$—$O_2$ plasma, to then form potential micro-tip portion 13'.

As shown in FIGS. 3A and 3B, in the same manner with the above-described fabrication method, micro-tip 13' is formed by selectively etching Ti adhesive layer 12 and the exposed Al mask 14' instantaneously using the BOE method. Thereafter, front substrate 19 spaced apart from rear substrate 11 wherein micro-tip 13' is formed and having striped anode 16 being across cathode 13 on the opposite plane of rear substrate 11, is disposed, and its edges are air-tightly sealed to then make the inside thereof vacuum, thereby completing the device.

As described above, in the field emission device and the fabrication method thereof according to the present invention, a micro-tip is fabricated such that the etching rate differences among tungsten cathode, lower titanium adhesive layer and upper aluminum mask, and the internal stress differences are made to be very large, and thus, tungsten micro-tip is protruded by the internal stress when adhesive layer and mask are instantaneously etched, thereby obtaining an even luminance owing to a precise tip size, ensuring the reproducibility in fabricating the device and elongating the overall device life.

What is claimed is:

1. A field emission device comprising:

a rear substrate;

an adhesive layer having a striped pattern disposed on said rear substrate;

a cathode, having the striped pattern, disposed on said adhesive layer;

a micro-tip protruded upwardly at a predetermined protrusion angle by etching a predetermined portion of said cathode in a triangular shape;

a mask layer disposed on the portion of said cathode where said micro-tip is not positioned;

an insulating layer, having the striped pattern, disposed on said mask layer;

a gate, having the striped pattern, disposed on said insulating layer;

a front substrate arranged with a surface opposed to said rear substrate, and spaced apart by a predetermined distance; and an anode, having a striped pattern perpendicular to the striped pattern of the cathode, disposed on said surface of said front substrate.

2. A field emission device as claimed in claim 1, wherein said adhesive layer is comprised of titanium or aluminum.

3. A field emission device as claimed in claim 1, wherein said cathode is comprised of tungsten.

4. A field emission device as claimed in claim 1, wherein said micro-tip has a predetermined protrusion angle.

5. A field emission device as claimed in claim 4, wherein said predetermined protrusion angle is 60°~70°.

6. A field emission device as claimed in claim 1, wherein said mask layer is comprised of aluminum.

7. A field emission device as claimed in claim 1, wherein said mask layer is comprised of titanium.

8. A field emission device as claimed in claim 1, wherein said gate is comprised of chromium.

9. A field emission device, comprising:

a front substrate and a rear substrate, each having inner surfaces disposed opposite to each other at a predetermined distance;

an adhesive layer disposed on said inner surface of said rear substrate;

an anode and a cathode disposed on the inner surface of said front substrate and on said adhesive layer, respectively;

a plurality of micro-tips protruding from said cathode;

a mask layer disposed on said cathode;

an insulating layer disposed on said mask layer; and a gate disposed on said insulating layer;

wherein said adhesive layer, said cathode, said mask layer, said insulating layer, and said gate have a first striped pattern and said anode has a second striped pattern which is perpendicular to the first striped pattern.

10. A field emission device according to claim 9, wherein said micro-tips are formed by etching said cathode using said mask layer by means of $CF_4$—$O_2$ plasma.

11. A field emission device as claimed in claim 9, wherein said adhesive layer is comprised of titanium or aluminum.

12. A field emission device as claimed in claim 9, wherein said cathode is comprised of tungsten.

13. A field emission device as claimed in claim 9, wherein said micro-tips have a predetermined protrusion angle.

14. A field emission device as claimed in claim 13, wherein said predetermined protrusion angle is 60° to 70°.

15. A field emission device as claimed in claim 9, wherein said mask layer is comprised of aluminum.

16. A field emission device as claimed in claim 9, wherein said mask layer is comprised of titanium.

17. A field emission device as claimed in claim 9, wherein said gate is comprised of chromium.

18. A field emission device as claimed in claim 9, wherein the thickness of said adhesive layer is about 2,000 Å.

19. A field emission device as claimed in claim 9, wherein the thickness of the mask layer is in a range of 1,500 Å to 2,000 Å.

20. A field emission device as claimed in claim 9, wherein the thickness of the cathode is about 1 μm.

* * * * *